US006679515B2

(12) United States Patent
Carrasca

(10) Patent No.: US 6,679,515 B2
(45) Date of Patent: Jan. 20, 2004

(54) HINGE STRAP FOR SNOWBOARD CONVENTIONAL BINDING

(75) Inventor: Robert G. Carrasca, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 10/265,511

(22) Filed: Oct. 4, 2002

(65) Prior Publication Data

US 2003/0038456 A1 Feb. 27, 2003

Related U.S. Application Data

(63) Continuation of application No. 09/757,441, filed on Jan. 9, 2001.

(51) Int. Cl.[7] ..... A63C 9/06; A63C 9/10; B62B 15/00

(52) U.S. Cl. ..... 280/619; 280/624; 280/14.22

(58) Field of Search ..... 280/624, 617, 280/620, 619, 623, 625, 626, 14.21, 14.22, 14.24; 36/50.5; 24/178, 306, 307, 197; 403/53

(56) References Cited

U.S. PATENT DOCUMENTS

| | | | | |
|---|---|---|---|---|
| 4,424,636 A | | 1/1984 | Everest | |
| 5,365,679 A | | 11/1994 | Chemello | |
| 5,553,401 A | | 9/1996 | Wittmann et al. | |
| 5,575,090 A | | 11/1996 | Condini | |
| 5,606,808 A | | 3/1997 | Gilliard et al. | |
| 5,727,797 A | | 3/1998 | Bowles | |
| 5,758,895 A | | 6/1998 | Bumgarner | |
| 5,771,609 A | | 6/1998 | Messmer | |
| 5,842,293 A | | 12/1998 | Young | |
| 5,845,371 A | | 12/1998 | Chen | |
| 5,852,884 A | | 12/1998 | Miotto | |
| 5,937,546 A | | 8/1999 | Messmer | |
| 5,960,567 A | | 10/1999 | Borel | |
| 5,966,843 A | | 10/1999 | Sand et al. | |
| 5,971,407 A | * | 10/1999 | Zemke et al. | 280/14.22 |
| 6,012,237 A | | 1/2000 | Okajima et al. | |

(List continued on next page.)

FOREIGN PATENT DOCUMENTS

| | | | | |
|---|---|---|---|---|
| DE | G 91 13 766.7 U1 | | 4/1992 | |
| DE | 44 16 024 C1 | | 10/1995 | |
| DE | 195 04 026 C1 | | 8/1996 | |
| EP | 0891793 A2 | * | 1/1999 | 280/613 |
| JP | 187903 | | 7/1999 | |
| WO | WO 96/24412 | | 8/1996 | |

OTHER PUBLICATIONS

Breuer, O., "Snowboard Binding," PTO–02–1515, translated by the Ralph McElroy Translation Company, United States Patent and Trademark Office, Feb. 2002.

*Primary Examiner*—Brian L. Johnson
*Assistant Examiner*—Gerald B Klebe
(74) *Attorney, Agent, or Firm*—Christensen O'Connor Johnson Kindness PLLC

(57) ABSTRACT

A conventional (strap) binding assembly for use with a snowboard. The binding assembly comprises a frame (120) having a base portion (122) that receives a snowboard boot. A pair of side walls (124) extend upwardly from either side of the base, and a high back portion (24) extends upwardly from the rearward end of the base. An ankle strap assembly (130) having a first ankle strap (131) attached to one side of the frame and a second ankle strap (135) attached to the other side of the frame, is provided, including a clasp (140) for adjustably securing the first ankle strap to the second ankle strap. In some embodiments the first ankle strap is attached to the frame with a biased hinge assembly (150), biasing the distal end **(131*b*) of the strap away from the frame. In a preferred embodiment, a toe strap assembly (160)**, functionally similar to the ankle strap assembly is also provided, disposed forwardly of the ankle strap assembly.

12 Claims, 5 Drawing Sheets

U.S. PATENT DOCUMENTS 6,038,791 A 3/2000 Cornelius et al.
6,056,300 A 5/2000 Carpenter et al.
6,065,768 A * 5/2000 Lee ..... 280/613
6,076,848 A 6/2000 Rigal et al.
6,128,837 A 10/2000 Huang
6,155,577 A 12/2000 Okajima
6,206,403 B1 3/2001 Black et al.
6,283,482 B1 9/2001 Coulter
6,394,484 B1 * 5/2002 Maravetz et al. ..... 260/624

* cited by examiner

HINGE STRAP FOR SNOWBOARD CONVENTIONAL BINDING

CROSS REFERENCE TO RELATED APPLICATION

This application is a continuation of co-pending application Ser. No. 09/757,441, filed Jan. 9, 2001, priority from the filing date of which is hereby claimed under 35 U.S.C. §120.

FIELD OF THE INVENTION

The present invention relates generally to bindings for sports equipment and, more particularly, to sport boots and bindings for releasable attachment to snow boards and the like.

BACKGROUND OF THE INVENTION

The sport of snowboarding has been practiced for many years, and has grown in popularity in recent years, establishing itself as a popular winter activity rivaling downhill skiing. In snowboarding a rider stands with both feet atop a single board, and negotiates a gravity-propelled path down a snow-covered slope. Both of the rider's feet are secured to the snowboard, and the rider controls speed and direction by shifting his or her weight and foot positions. A particularly important aspect of controlling the snowboard is rotating the snowboard about its longitudinal axis, thereby selecting which lateral edge of the snowboard engages the snow, the angle of engagement and the orientation of the snowboard with respect to the slope of the terrain.

In order to control the orientation of the snowboard, the rider wears boots that are firmly secured to the snowboard in an orientation that is generally transverse to the longitudinal axis of the snowboard. In this stance, the rider can raise the toe-side edge of the snowboard by leaning backward and rotating his/her feet, for example, and can rotate board within the plane of the board, and/or about the boards short axis, by appropriate foot movement. In order to accomplish precise control of the snowboard, the soles of the rider's boots must therefore be firmly attached to the board. Mechanisms for releasable attaching snowboard boots to the snowboard are called snowboard bindings. Many binding mechanisms have been developed, generally categorized as either strap bindings (also called conventional bindings) wherein a pair of frames having straps for releasably securing the rider's boots is attached to the board, and step-in bindings wherein cleat mechanisms are integrated into the sole of the snowboard boots and a complementary cleat-engagement mechanism is attached to the snowboard.

In strap bindings, the binding frame typically includes a flat base portion that receives the sole of the boot. The base portion attaches to the board, frequently in an adjustable manner such that the rider can select a particular angle between the boot axis and the board axis. Integral side walls extend upwardly from either side of the base portion, providing lateral support to the attached boot, and a high back portion extends vertically from the back. The high back portion is important particularly when the rider is using soft boots, as it enables the rider to raise the toe-side edge of the board by leaning backwardly against the high back portion. Typically, two pairs of straps are attached to the frame side walls, the straps being adapted to extend over the rider's boots and adjustably interconnect, to secure the snowboard boots to the snowboard. The first pair of straps extends generally around the ankle portion of the boot, and the second pair extends generally over the toe portion of the boot.

A common problem encountered with conventional snowboard bindings is that as the rider mounts the snowboard by stepping onto the base portion of the frame, the straps can get in the way of the rider, sometimes becoming trapped behind or underneath the rider's boots, requiring the rider to adjust his/her feet and attempt to pull the straps out and over the boots. This task can be particularly difficult and frustrating when the rider is re-mounting a snowboard in the field, for example, after dismounting the snowboard to traverse level portion of a run. In this case, the boots, straps, binding, and snowboard may be covered with snow, the rider is typically wearing gloves and bulky clothing, and the snowboard and rider may be situated on an inclined and/or slippery snowy field. Under these conditions, properly orienting and securing the binding straps can be particularly challenging.

In addition to the physical difficulties associated with properly mounting the snowboard, physical damage and undesirable wear and tear can be caused to the strap assembly. The straps, and particularly the clasping mechanism for securing the straps, can be damaged, for example, if the rider inadvertently steps on the straps or imposes sharp bends in the straps between the boot and the high back portion of the frame. Moreover, the process of pulling the straps (including the clasp mechanism) out from between the boot and the frame can result in unnecessary stresses and strains in the strap assembly.

SUMMARY OF THE INVENTION

The present invention is directed to a conventional, or strap-type, snowboard boot binding that facilitates easy mounting of the snowboard by the rider. The improved snowboard boot binding includes a high back frame for receiving a snowboard boot that is secured to the snowboard, and at least one hinged strap assembly, wherein the hinged strap assembly includes: (i) a first strap attached at one end to one side of the frame and the other end having a clasp mechanism, (ii) a second strap attached at one end to the other side of the frame and adapted to be adjustably engaged by the clasp mechanism, and (iii) a hinge mechanism attached to the at least one of the first strap and the second strap, the hinge permitting the attached strap to swing outwardly, away from the frame.

In an embodiment of the invention, the hinge mechanism includes a simple hinge wherein the hinged strap is connected to the frame by a hinge plate attached to the frame, a hinge arm attached to the strap, and a pivot pin pivotally connecting the hinge plate to the hinge arm.

In a second embodiment of the invention, the hinge mechanism includes an elastically deformable, V-shaped plate connecting the strap to the frame, wherein the V-shaped plate can be non-plastically deformed to a generally flat configuration for binding the snowboard boot to the snowboard.

In another embodiment of the invention, the hinge mechanism is provided with a biasing member, such as a coil spring, that urges the strap toward an open position, with the distal end of the strap urged away from the frame.

It is an aspect of the present invention that some or all of the straps used to bind the snowboard boot to the snowboard can be positioned away from the frame, thereby making it easier to mount the snowboard by reducing or eliminating the possibility that the rider will inadvertently step on, or otherwise trap the binding straps behind or under the snowboard boot.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
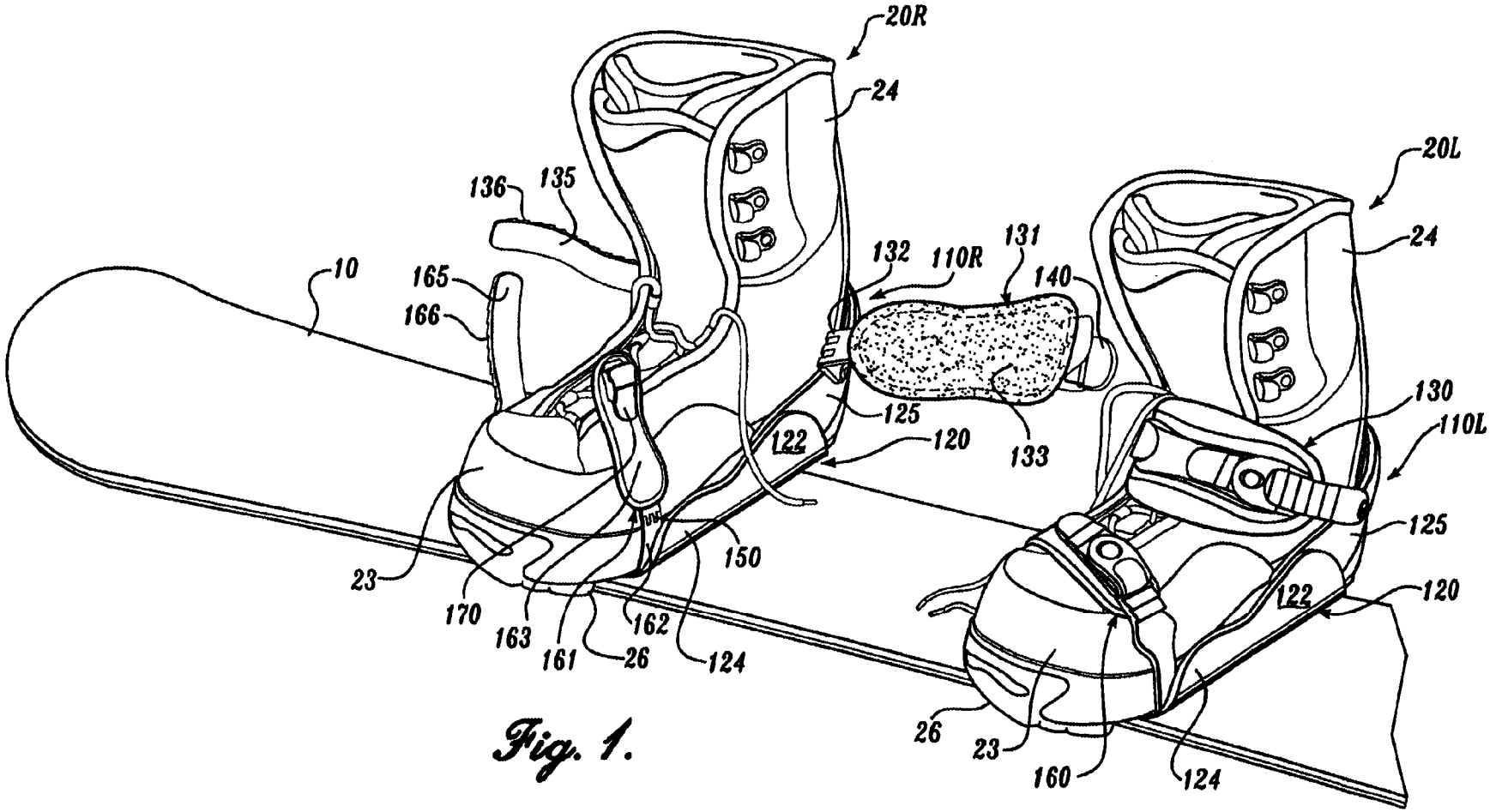
FIG. 1 is a perspective view of a pair of snowboard boots on a snowboard with a strap binding according to a first embodiment of the present invention, with the straps for the left side boot clasped to attach the boot to the snowboard, and the straps for the right side boot unclasped.

A snowboard binding made in accordance with the present invention is illustrated in FIG. 1, which shows a perspective view of two snowboard boots 20L, 20R atop a snowboard 10. A pair of snowboard bindings 110L, 110R support the boots 20L, 20R. As seen most clearly in FIG. 2 which shows binding 110R, the binding includes a frame 120 that is secured to the snowboard 10. The frame 120 includes a generally flat base portion 122 that is designed to receive and provide a stable platform for the sole 26 of the boot 20. Integral side walls 124 extend upwardly from either side of the base portion 122, and an elongate high back portion 126 extends generally upwardly from the rear of the base portion 122. The side walls 124 include a generally U-shaped connecting portion 125 at the rearward end that cooperatively with other portions of the frame 120 form a heel cup. In a preferred embodiment the high back portion 126 is shaped and curved to generally conform to the exterior of the high back ankle portion 24 of the boot 20. A mechanism 121 is included for adjusting the angle formed between the high back portion 126 and the base portion 122 to accommodate the preferences of the rider. The side walls 124 of the frame 120 are spaced apart to accommodate the boot 20 therebetween.

Although the bindings 110L, 110R are shown attached in a single position on the snowboard 10, it is contemplated by this invention that one or both of the bindings 110L, 110R, may be adjustably disposed on the snowboard 10 such that the angular orientation of the bindings 100 may be selectively modified, or the longitudinal position of the bindings may be adapted to accommodate the rider's needs and preferences. It is also contemplated that the present invention could be practiced using a frame that is adjustable either laterally or longitudinally (or both) to accommodate different sizes of snowboard boots.

The frame 120 may be made from any suitably strong and stiff material, or combination of materials, including plastics, graphite composites, aluminum, and/or magnesium. In a preferred embodiment, for example, the base portion 122 and side walls 124 are made from injection-molded magnesium, with an aluminum rearward heel cup portion, and the high back portion 126 is made from a carbon composite.

An ankle strap assembly 130 is attached near the rearward end of the side walls 124 (in the disclosed embodiment, on the connecting portion 125). The ankle strap assembly includes a first ankle strap 131, a second ankle strap 135, and a clasp 140 for releasably securing the first ankle strap 131 to the second ankle strap 135. The first ankle strap 131 has a proximal end 131*a* and a distal end 131*b*. The proximal end 131*a* is pivotally attached to a rearward portion of the frame 120. The clasp 140 is attached to the distal end 131*b* of the first ankle strap 131.

The first ankle strap 131 includes a narrow proximal section 132 extending from the proximal end 131*a*, and a wider distal section 133 extending from the proximal section 132 to the distal end 131*b*. The distal section 133 is preferably contoured to approximately conform to the outer portion of the boot 20 engaged by the first ankle strap 131, and may additionally be padded or otherwise resilient. The wider distal section 133 spreads the forces generated by the tension in the ankle strap 131 over a larger portion of the boot 20, to increase the comfort of the rider. Additionally, the interface between the proximal section 132 and the distal section 133 may include an adjustment mechanism 134 (shown in FIG. 3) to permit gross adjustments in the total length of the first ankle strap 131 and the position of the wider distal section 133.

The second ankle strap 135 includes a proximal end 135*a* and a distal end 135*b*. The proximal end 135*a* is attached to a rearward portion of the frame 120, generally opposite the first ankle strap 131. The second ankle strap 135, sometimes referred to as a ladder strap, includes a plurality of transverse ridges 136 along one side of the strap that cooperate with the clasp 140 to adjustably secure the first ankle strap 131 with the second ankle strap 135 when the second ankle strap 135 is inserted into the clasp 140. It will be appreciated that although the present invention has been described in terms of a clasping mechanism and a ladder strap, numerous other clasping mechanisms are known in the art. The present invention can be practiced with any appropriate securing mechanism for adjustably connecting the first ankle strap 131 to the second ankle strap 135.

Figure 3:
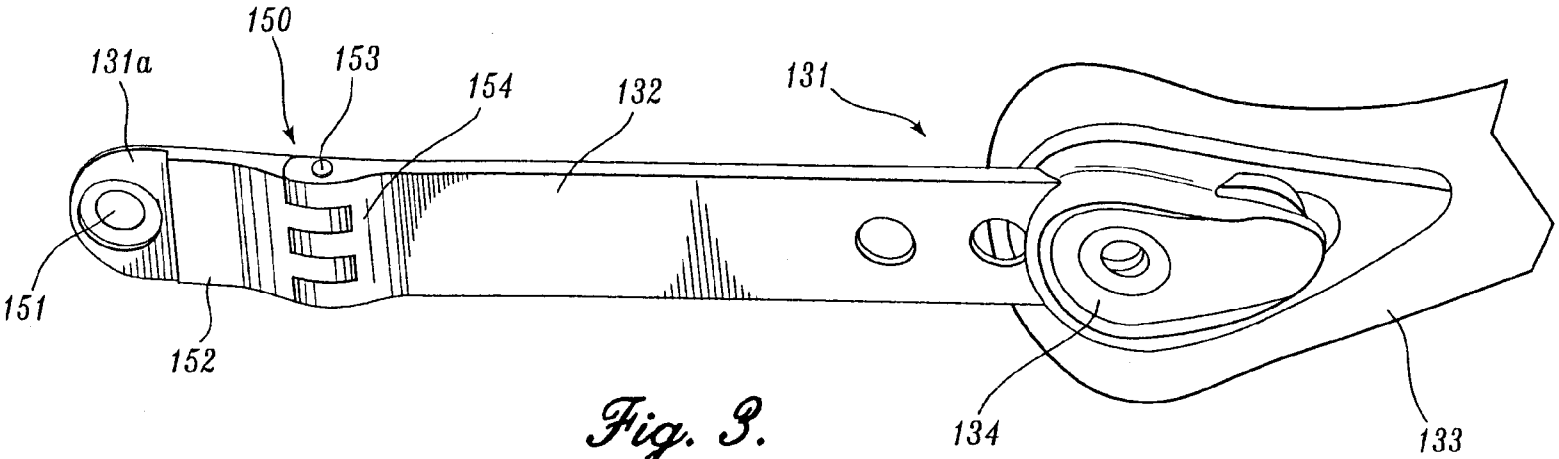
FIG. 3 is a close-up perspective view of a portion of the ankle strap shown in FIG. 2, showing the hinge mechanism at the base of the strap.

As seen most clearly in FIG. 3, which shows a close-up view of a portion of the first ankle strap 131, the first ankle strap 131 includes a hinge assembly 150. The hinge assembly 150 includes a hinge base 152 that includes a hole 151 that is used to secure the hinge base 152 to the frame 120 with a connector such as a screw or rivet (not shown). In the disclosed embodiment the connector permits the first ankle strap 131 to pivot generally about an axis transverse to the frame base portion 122, permitting the strap to be adjusted to cross the rider's foot at a convenient location. A hinge arm 154 is pivotally connected to the hinge base 152 with a hinge pin 153.

Figure 5:
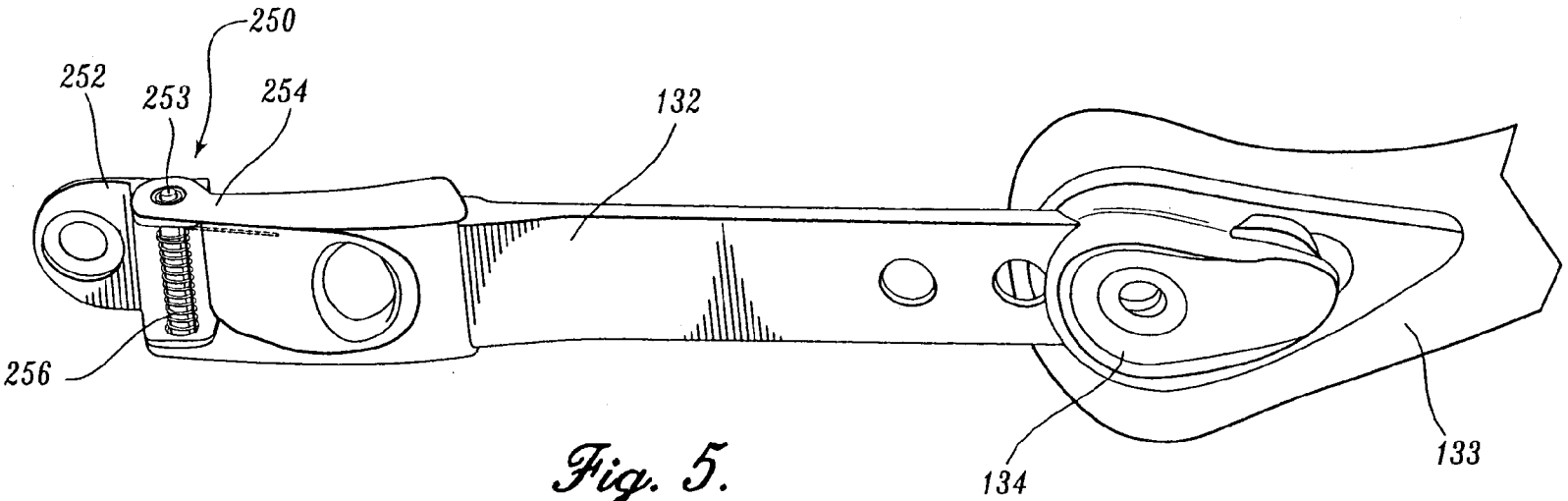
FIG. 5 is a perspective view of a third embodiment of a strap hinge according to the present invention, wherein a spring is used to bias the hinge toward an open position.

In a second embodiment of the first ankle strap 231, shown in FIG. 5, a hinge assembly 250 includes a hinge arm 254 that is pivotally connected to a hinge base 252 with a hinge pin 253. The hinge arm 254 is rotationally biased toward the hinge base 252 with a biasing member such as a spring 256, such that the distal end 131*b* of the first ankle strap 131 is biased away from the frame 120.

It will be appreciated that the biasing member 256 is selected to produce a biasing force that is large enough to rotate the unencumbered first ankle strap 131, and small enough that it is not unduly difficult for the rider to rotate the first ankle strap 131 against the biasing force, and the clasp 140 can easily maintain the first ankle strap 131 in a clasped configuration against the biasing force.

Figure 2:
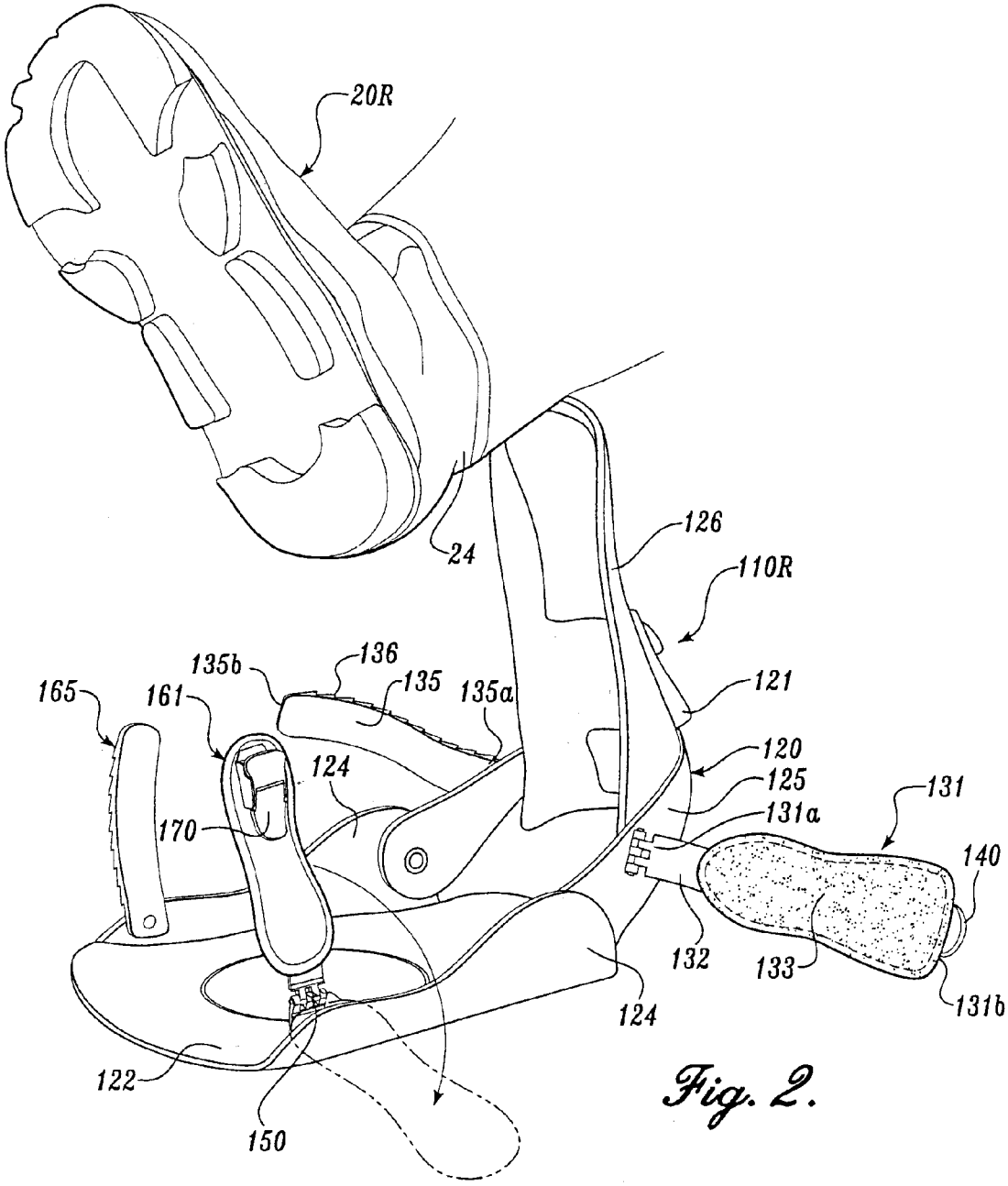
FIG. 2 is a perspective close-up view of the right side bindings shown in FIG. 1, with a rider's foot mounting the binding.

In the preferred embodiment depicted in FIGS. 1–2, a toe strap assembly 160, similar in function to the ankle strap assembly 130, is also provided. The toe strap assembly 160 includes a first toe strap 161, a second toe strap 165, and a clasp 170 for releasably securing the first toe strap 161 to the second toe strap 165. The proximal end of the first toe strap 161 is pivotally attached to a forward portion of side wall 124, and a clasp 170 is attached to the distal end of the first toe strap 161.

The first toe strap 161 is generally similar to the first ankle strap 131, and includes a narrow proximal section 162 extending from the proximal end, and a wider distal section 163 extending from the proximal section 162 to the distal end of the first toe strap 161. The distal section 163 is preferably contoured to approximately conform to the outer portion of the boot 20 engaged by the first toe strap 161, and may additionally be padded or otherwise resilient. The interface between the proximal section 162 and the distal section 163 may include an adjustment mechanism (not shown) to permit gross adjustments in the total length of the first ankle strap 161.

The proximal end of the second toe strap 165 is attached to a forward portion of side wall 124. The second toe strap 165 includes a plurality of transverse ridges 166 along one side of the strap that cooperate with the clasp 170 to adjustably secure the first toe strap 161 to the second toe strap 165 when the second toe strap 165 is inserted into the clasp 170.

The proximal end of the first toe strap 161 is provided with a hinge assembly 150, that may include a biasing mechanism 256, functionally equivalent to the hinge assembly 250 described above and shown in FIG. 5.

In the disclosed embodiment the hinge assemblies 150 are provided at the proximal ends of the first ankle strap 131 and the first toe strap 161, but not on the second ankle strap 135 or the second toe strap 165. This configuration is currently preferred because the second ankle strap 135 and the second toe strap 165 are generally lighter than their corresponding straps 131, 161, and tend to naturally extend away from the frame 120 upon release from the clasps 140, 170. Moreover, if both straps on one side of the binding can hinge out of the way, it is relatively easy for the rider to mount the binding from the "open" side, and therefore a hinge structure on the opposite side may not be necessary. It is contemplated by this invention, however, and may be preferred in some applications, that the second straps 135, 165 may be provided with a hinge assembly functionally equivalent to hinge assembly 150, such that the second straps 135, 165 may also be positioned away from the frame 120.

Figure 4:
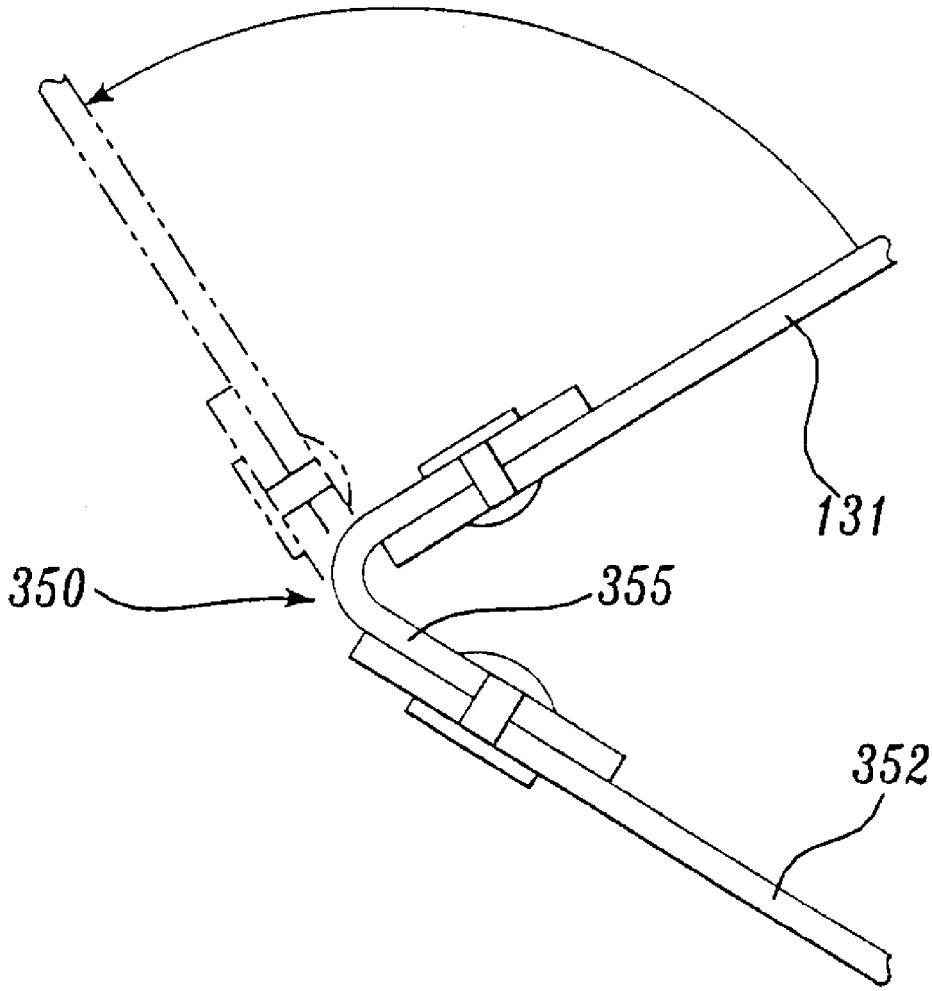
FIG. 4 is a side view of another embodiment of a hinge strap according to the present invention utilizing an elastically deformable V-shaped hinge element.

A third embodiment of a hinge assembly 350 for the first ankle strap 131 according to the present invention is shown in FIG. 4. In this third embodiment, a V-shaped elastic hinge member 355 is attached to and between the hinge base 352 and the first ankle strap 131. The elastic hinge member 355 is oriented such that the strap 131 is biased towards an open position, i.e., away from the frame 120. The elastic hinge member 355 can be elastically deformed to a generally flat configuration, for releasably attaching the first strap 131 to the second strap 135, without plastically deforming the member 355. The elastic hinge member 355 can be attached to the strap 131 and hinge plate 352 (or directly to the side wall 124) using any suitable attachment means, including for example, rivets, screws or snaps. Although the elastic hinge member 355 is disclosed with the first ankle strap 131, it will be apparent that the same structure can also be applied to any combination of straps 131, 135, 161, and 165.

Figure 6:
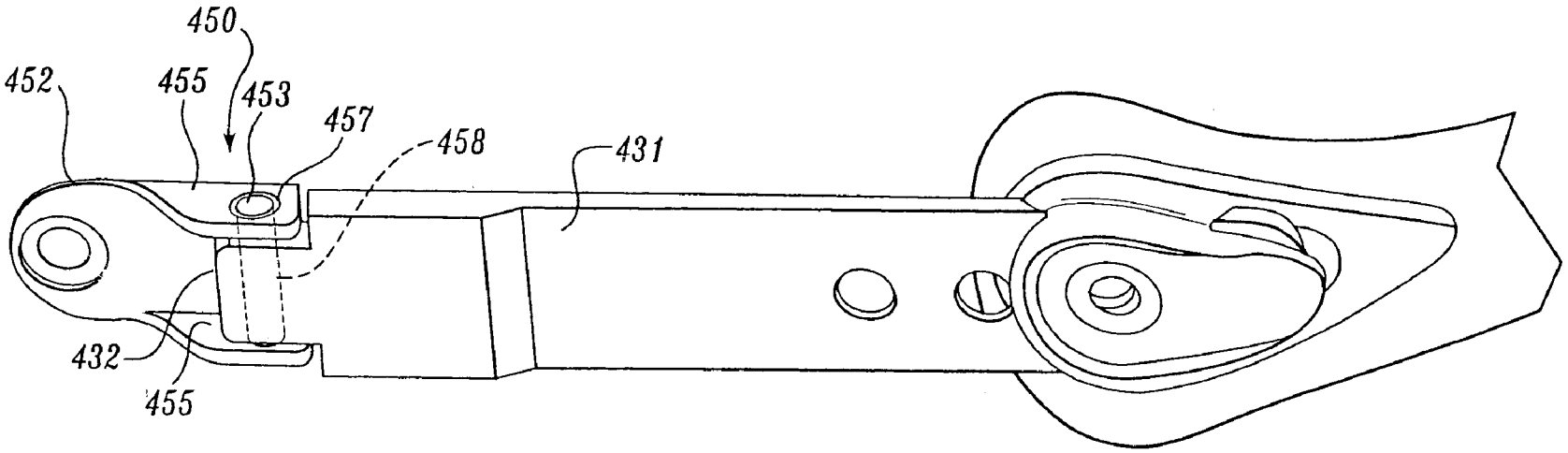
FIG. 6 is a perspective view of a fourth embodiment of a strap hinge according to the present invention, wherein the strap pivots about the hinge pin and preferentially snaps between a first and second position.

A fourth embodiment of a hinge assembly 450 for the ankle strap 131 according to the present invention is shown in FIG. 6. In this fourth embodiment, the proximal end 132 of the ankle strap 131 is pivotally attached to a hinge base 452, with a hinge pin 453 that extends through an aperture 458 spanning the width of the strap 131. A pair of oppositely disposed side panels 455 project generally perpendicular to, and on either side of, the hinge base 452. Each side panel 455 includes an aligned aperture 457 therethrough, providing support for the hinge pin 453. The strap 131 is sized to fit between the side panels 455, as shown in FIG. 6, such that the strap aperture 458 is aligned with the hinge side wall apertures 457, whereby the hinge pin 453 can be inserted through the first side wall aperture 457, the strap aperture, and the second side wall aperture 457 to pivotally attach the strap 431 to the hinge base 452.

In a preferred embodiment, the strap 131 is made from a relatively elastic material, and the proximal end 432 of the strap is at least partially squared off. The strap 131 is positioned between the side panels 455 with the strap side disposed against or very near to the hinge base 452. It will be appreciated that in this embodiment the edges of the squared-off distal end 432 of the strap will interfere with the hinge base 452 when the user attempts to pivot the strap 131 about the hinge pin 453. By the appropriate and straightforward selection of the elasticity of the strap material and the position of the strap aperture 458, the interference between the strap distal end 432 and the hinge base 452 can be selected such that the strap 131 will preferentially "snap" into an open position with the surface of the distal end 432 adjacent the hinge base 452, as the strap 131 is pivoted outwardly.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snowboard boot binding comprising:

(a) a frame for receiving a snowboard boot, the frame being secured to a snowboard, the frame including a base plate, a lateral side and a medial side, and a high back portion extending upwardly from a rearward end of the base plate;

(b) a first ankle strap having a proximal portion attached to the lateral side of the frame, and a distinct and relatively wide distal portion that is adapted to approximately conform to the received snowboard boot, the relatively wide distal portion hingedly connected to the proximal portion such that the distal portion is pivotable between a closed position disposed generally over the base plate, and an open position disposed not over the base plate, the first ankle strap further comprising a clasp; and (c) a second ankle strap having a proximal end connected to the medial side of the frame and a distal end adapted to engage the first ankle strap clasp when the distal portion of the first ankle strap is in the closed position.

2. The snowboard boot binding of claim 1, further comprising a biasing mechanism adapted to urge the distal portion of the first ankle strap toward the open position.

3. The snowboard boot binding of claim 2, wherein the biasing mechanism comprises a coil spring.

4. The snowboard boot binding of claim 2, wherein the biasing mechanism comprises a V-shaped elastic member.

5. A strap-type snowboard binding comprising:

a frame for receiving a snowboard boot, the frame having a base portion adapted to receive a snowboard boot, the frame having first and second sides defining oppositely disposed sidewalls, and a high back portion that extends upwardly from a rear portion of the base;

a strap assembly including i): a first strap having a proximal end attachable to the first side of the frame, the first strap comprising a narrow proximal portion and a wider distal portion that is adapted to approximately conform to the received boot; ii) a narrow second strap having a proximal end attachable to the second side of the frame; and iii) a clasp mechanism attached to the distal portion of the first strap for releasably connecting the first strap with the second strap; and wherein the proximal portion of the first strap and the distal portion of the first strap are distinct, and further wherein the distal portion of the first strap is hingedly attached to the proximal portion of the first strap such that the distal strap portion is pivotable between a first position disposed directly over the base portion and a second position that is not directly over the base portion.

6. The snowboard binding of claim 5, wherein the proximal strap portion comprises a hinge plate that is attached to the frame and further comprising a hinge pin hingedly connecting the hinge plate to the distal strap portion.

7. The snowboard binding of claim 6, wherein the hinge plate is pivotally attached to the frame.

8. The snowboard binding of claim 5, comprising a second strap assembly disposed to clasp about a toe portion of the boot.

9. The snowboard binding of claim 5, further comprising a heel counter that connects the high back portion of the frame with the base portion, and wherein the first strap attaches to the heel counter.

10. The snowboard binding of claim 5, further comprising a biasing member that biases the distal strap portion toward the second position.

11. The snowboard binding of claim 10, wherein the biasing member is a coil spring.

12. The snowboard binding of claim 10, wherein the biasing member is a V-shaped elastic member.

* * * * *